US011427426B2

(12) United States Patent
Yamada

(10) Patent No.: US 11,427,426 B2
(45) Date of Patent: Aug. 30, 2022

(54) SORTING DEVICE AND IMAGE FORMING APPARATUS PROVIDED THEREWITH

(71) Applicant: KYOCERA Document Solutions Inc., Osaka (JP)

(72) Inventor: Tomoyasu Yamada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/335,517

(22) Filed: Jun. 1, 2021

(65) Prior Publication Data

US 2021/0380365 A1 Dec. 9, 2021

(30) Foreign Application Priority Data

Jun. 5, 2020 (JP) ..... JP2020-098320

(51) Int. Cl.

| | |
|---|---|
| ***B65H 31/22*** | (2006.01) |
| ***B65H 29/60*** | (2006.01) |
| ***B65H 31/24*** | (2006.01) |
| ***B65H 31/02*** | (2006.01) |
| ***B65H 29/12*** | (2006.01) |

(52) U.S. Cl.
CPC ..... *B65H 29/60* (2013.01); *B65H 29/125* (2013.01); *B65H 31/02* (2013.01); *B65H 31/24* (2013.01)

(58) Field of Classification Search
CPC ..... B65H 31/22
See application file for complete search history.

(56) References Cited

U.S. PATENT DOCUMENTS

| | | | | |
|---|---|---|---|---|
| 6,227,536 | B1 * | 5/2001 | Bethke | B65H 31/02 271/207 |
| 6,542,715 | B2 * | 4/2003 | Miyamoto | B65H 31/24 270/58.08 |
| 6,634,640 | B1 * | 10/2003 | Yoshizawa | B65H 31/22 271/213 |
| 7,657,205 | B2 * | 2/2010 | Kang | B65H 31/22 399/407 |
| 7,949,294 | B2 * | 5/2011 | Nagata | B65H 31/10 399/407 |

(Continued)

FOREIGN PATENT DOCUMENTS

| | | |
|---|---|---|
| JP | 2006-240759 A | 9/2006 |
| JP | 2017-146502 A | 8/2017 |

*Primary Examiner* — Leslie A Nicholson, III
(74) *Attorney, Agent, or Firm* — Stein IP, LLC

(57) ABSTRACT

A sorting device is mounted, in an image forming apparatus, in a sheet discharge space open at its front and sheet-discharge-direction downstream side, insertably or extractably at the downstream side. The sorting device includes a base portion, a tray portion, and a flexible member. The base portion is mounted, with the tray portion, in the base portion. The base portion has, in its upstream part in sheet discharge direction, a base inclined portion inclined upward downstream. With the base portion mounted in the bottom portion, the base inclined portion faces, across a predetermined gap, a bottom inclined surface inclined upward downstream in discharge direction. The tray portion is supported on the base portion to be reciprocatable in sheet width direction orthogonal to discharge direction. The flexible member is fitted to the base inclined portion and fills the gap between the base inclined portion and the bottom inclined surface.

7 Claims, 5 Drawing Sheets

(56) References Cited

U.S. PATENT DOCUMENTS

| | | | | |
|---|---|---|---|---|
| 8,213,854 | B2 * | 7/2012 | Iida | B65H 5/26 270/58.08 |
| 8,960,673 | B2 * | 2/2015 | Yoshida | G03G 15/6552 271/306 |
| 10,005,637 | B1 * | 6/2018 | Wilsher | B65H 31/3054 |
| 10,035,676 | B2 * | 7/2018 | Shirasaki | G03G 15/6541 |
| 11,254,536 | B2 * | 2/2022 | Noda | B65H 31/24 |
| 11,261,051 | B2 * | 3/2022 | Isobe | B65H 29/14 |
| 2006/0210337 | A1 | 9/2006 | Nagata et al. | 399/407 |
| 2017/0240376 | A1 | 8/2017 | Shirasaki | |

* cited by examiner

SORTING DEVICE AND IMAGE FORMING APPARATUS PROVIDED THEREWITH

INCORPORATION BY REFERENCE

This application is based on and claims the benefit of Japanese Patent Application No. 2020-98320 filed on Jun. 5, 2020, the contents of which are hereby incorporated by reference.

BACKGROUND

The present disclosure relates to a sorting device that is mounted in a sheet discharge space in an image forming apparatus, and relates also to an image forming apparatus provided with such a sorting device.

Sheet post-processing devices are generally used that can perform processing such as binding, i.e., stacking a plurality of sheets having images formed on them by an image forming apparatus such as a copier, a printer, or the like and then binding the bundle of the stacked sheets together with a staple; punch hole formation, i.e., forming punch holes (perforations) in sheets with a punch hole forming device; and sorting (classifying) sheets into separate bundles.

Inconveniently, attaching such a sheet post-processing device to a side surface of an image forming apparatus causes the image forming apparatus to require an installation space as much larger as the attached sheet post-processing device. To avoid that, in a known image forming apparatus, a sheet post-processing device is disposed slidably in a space (in-body discharge space) that is formed inside the apparatus main body by a document reading portion, a printing portion, and a sheet feeding portion.

SUMMARY

According to one aspect of the present disclosure, a sorting device is mounted in a sheet discharge space in an image forming apparatus, wherein the sheet discharge space is open at the front of the image forming apparatus and at the downstream side of it in the sheet discharge direction and wherein the sorting device is mounted so as to be insertable or extractable at the downstream side of the image forming apparatus. The sorting device includes a base portion, a tray portion, and a flexible member. The base portion is mounted integrally with the tray portion so as to be insertable or extractable along the top surface of the bottom portion from the downstream side in the sheet discharge direction. The tray portion is supported on the base portion so as to be reciprocatable in the sheet width direction orthogonal to the sheet discharge direction. The base portion has, on an upstream part of it in the sheet discharge direction, a base inclined portion inclined upward from upstream side toward the downstream side. With the base portion mounted on the bottom portion, the base inclined portion faces, with a predetermined gap, a bottom inclined surface provided in an upstream part of the bottom portion in the discharge direction, the bottom inclined surface being inclined upward from upstream side toward the downstream side. The flexible member is attached to the base inclined portion, and fills the gap between the base inclined portion and the bottom inclined surface.

DETAILED DESCRIPTION

Figure 1:
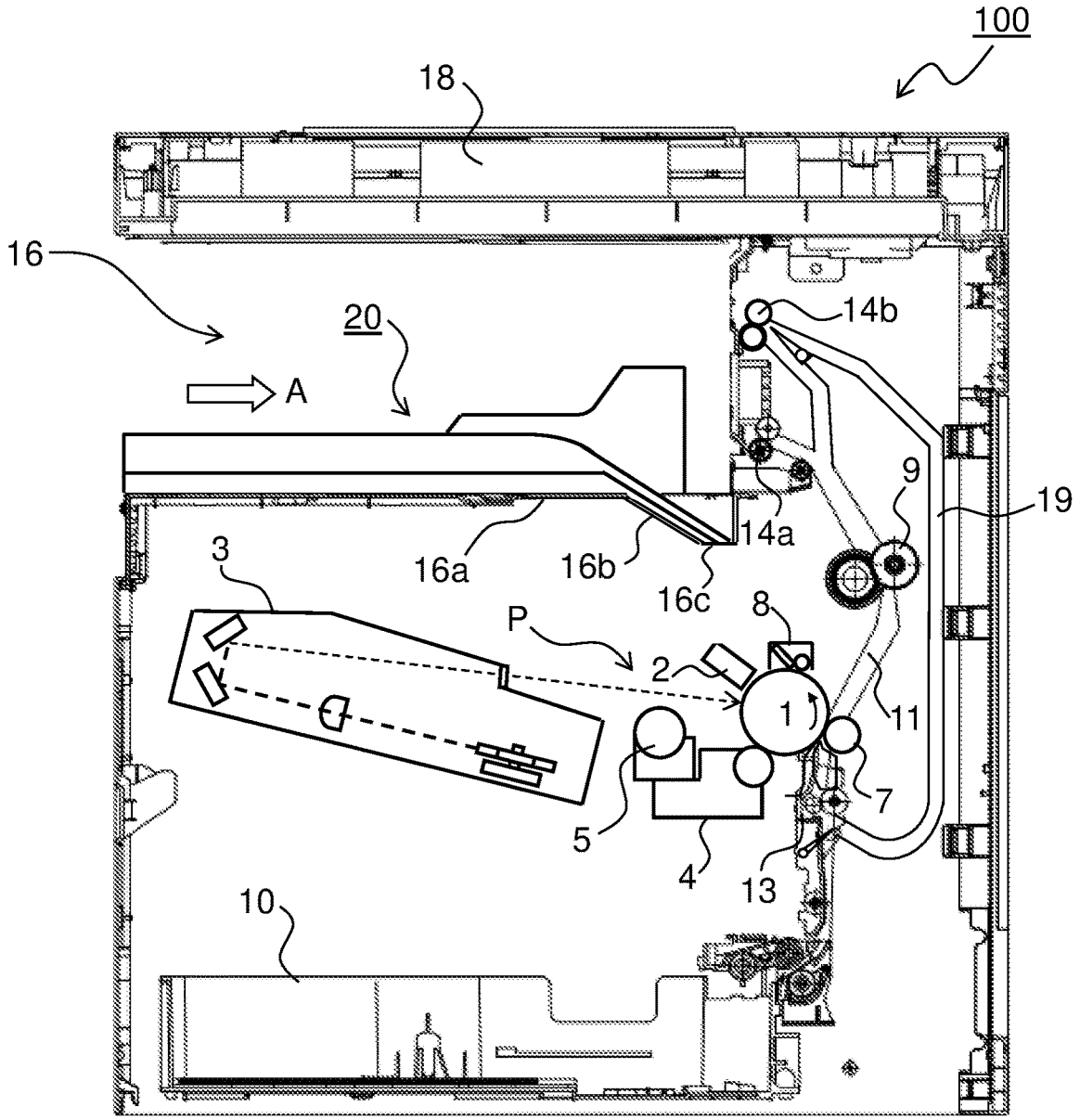
FIG. 1 is a schematic diagram showing an internal construction of an image forming apparatus having a sorting device according to the present disclosure mounted in it.

An embodiment of the present disclosure will be described below with reference to the accompanying drawings. FIG. 1 is a schematic diagram showing an internal construction of an image forming apparatus 100 and a sorting device 20 according to the embodiment. While the embodiment deals with a digital multifunction peripheral as one example of the image forming apparatus 100, the sorting device 20 according to the embodiment can be likewise coupled to other than a digital multifunction peripheral, such as a laser printer, an inkjet printer, or a facsimile machine.

As shown in FIG. 1, in a main body of the image forming apparatus (e.g., a monochrome multifunction peripheral) 100, there is disposed an image forming portion P that forms a monochrome image through the processes of electrostatic charging, exposure to light, image development, and image transfer.

In the image forming portion P, there are disposed, along the rotation direction (in FIG. 1, counter-clockwise) of a photosensitive drum 1, a charging portion 2, an exposure unit 3, a developing device 4, a transfer roller 7, a cleaning device 8, and a destaticizing device (not illustrated). In the image forming portion P, as the photosensitive drum 1 is rotated counter-clockwise in FIG. 1, an image formation process is performed with respect to the photosensitive drum 1.

The photosensitive drum 1 is, for example, a drum of aluminum that has a photosensitive layer deposited on it, and its surface is electrostatically charged uniformly by the charging portion 2. On the surface irradiated with a laser beam emitted from the exposure unit 3, which will be described later, an electrostatic latent image is formed through attenuation of electric charge. The photosensitive layer is not subject to any particular limitations, preferred examples including an amorphous silicon (a-Si) photosensitive layer, which boasts excellent durability, and an organic photosensitive layer (OPC), which produces little ozone and which yields a high-resolution image.

The charging portion 2 electrically charges the surface of the photosensitive drum 1 uniformly. Usable as the charging portion 2 is, for example, a corona discharge device that discharges electric charge by applying a high voltage to an electrode formed of thin wire or the like. Instead of a corona discharge device, use is also possible of a contact-type charging device that applies a voltage while keeping a charging member, which typically is a charging roller, in contact with the surface of the photosensitive drum 1. The exposure unit 3 shines a light beam (e.g., a laser beam) on the photosensitive drum 1 based on document image data read in an image reading portion 18, and thereby forms an electrostatic latent image on the surface of the photosensitive drum 1.

The developing device 4 attaches toner to the electrostatic latent image on the photosensitive drum 1, and thereby forms a toner image. The developing device 4 is supplied with toner from a toner container 5. Here, stored in the developing device 4 is one-component developer (hereinafter referred to simply as toner) containing only a magnetic toner component.

The transfer roller 7 transfers the toner image formed on the photosensitive drum 1, so as not to disturb it, to a sheet conveyed along a sheet conveyance passage 11. The cleaning device 8 includes a cleaning roller, a cleaning blade, or the like that makes line contact with the photosensitive drum 1 in its longitudinal direction, and removes residual toner that is left behind on the surface of the photosensitive drum 1 after the transfer of the toner image to the sheet.

The image reading portion 18 comprises, among others, a scanning optical system including a scanner lamp that illuminates a document during copying and a mirror that deflects the optical path of the light reflected from the document; a condenser lens that converges and focuses the light reflected from the document; and a CCD sensor that converts the focused image light into an electrical signal (none of these are illustrated).

Copying operation proceeds as follows. In the image reading portion 18, the image data of a document is read and converted into an image signal. On the other hand, in the image forming portion P, the charging portion 2 electrostatically charges uniformly the surface of the photosensitive drum 1 as it rotates counter-clockwise in FIG. 1. Next, based on the document image data read in the image reading portion 18, the exposure unit 3 shines a laser beam (a ray of light) on the photosensitive drum 1, and thereby forms an electrostatic latent image based on the image data on the surface of the photosensitive drum 1. Then the developing device 4 attaches toner to the electrostatic latent image, and thereby forms a toner image.

Toward the image forming portion P where the toner image has been formed as described above, a sheet is conveyed with predetermined timing from a sheet storage portion 10 through the sheet conveyance passage 11 via a pair of registration rollers 13. The toner image formed on the surface of the photosensitive drum 1 in the image forming portion P is then transferred to the sheet by the transfer roller 7. The sheet having the toner image transferred to it is separated from the photosensitive drum 1 and is conveyed to a fixing portion 9, where the sheet is heated and pressed so that the toner image is fixed to the sheet.

The sheet having passed through the fixing portion 9 is conveyed through the sheet conveyance passage 11 to a pair of discharge rollers 14*a* or 14*b*. When an image is formed only on one side of the sheet, the sheet is discharged by the pair of discharge rollers 14*a* into the sorting device 20 mounted in a sheet discharge space 16.

On the other hand, when images are formed on both sides of the sheet, the leading end of the sheet having passed through the fixing portion 9 is momentarily jutted out from the pair of discharge rollers 14*b* into the sheet discharge space 16. Next the pair of discharge rollers 14*b* is rotated reversely so that the sheet is switched back and guided into a reverse conveyance passage 19; thus the sheet is then conveyed, with the image side turned over, once again to the pair of registration rollers 13. Then the next image formed on the surface of the photosensitive drum 1 is transferred by the transfer roller 7 to the side of the sheet on which no image has been formed yet. Thereafter the sheet is conveyed to the fixing portion 9, where the toner image is fixed, and is then discharged by the pair of discharge rollers 14*a* into the sorting device 20.

The sorting device 20 is removably mounted in a bottom portion 16*a* of the sheet discharge space 16. The sorting device 20 performs sorting (classifying) whereby the sheets discharged from the pair of discharge rollers 14*a* are, in units of several sheets, moved alternately in the sheet width direction (the direction perpendicular to the plane of FIG. 1) orthogonal to the discharge direction. With the sorting device 20 removed from the sheet discharge space 16, the bottom portion 16*a* is used as a sheet discharge tray.

In the bottom portion 16*a*, a bottom inclined surface 16*b* and a recessed portion 16*c* are formed. The bottom inclined surface 16*b* is formed downstream of the bottom portion 16*a* with respect to the insertion direction (arrow-A direction) of the sorting device 20, and is inclined upward from the upstream side toward the downstream side in the sheet discharge direction. Sheets discharged by the pair of discharge rollers 14*a* into the bottom portion 16*a* slide down along the bottom inclined surface 16*b* to the upstream side in the discharge direction so as to be stacked with their trailing ends aligned. The recessed portion 16*c* is formed downstream of the bottom inclined surface 16*b* with respect to the insertion direction.

Figure 2:
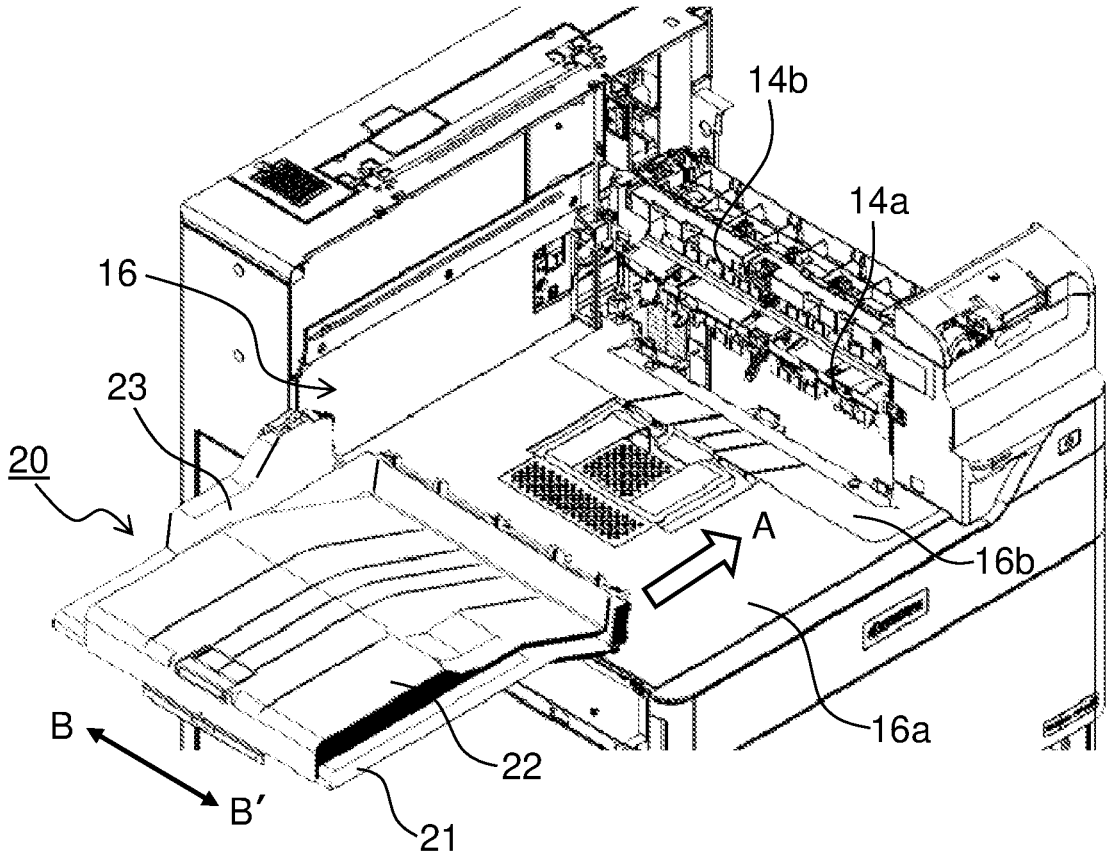
FIG. 2 is a perspective view showing how the sorting device is mounted in a sheet discharge space in the image forming apparatus, as seen from above.
Figure 3:
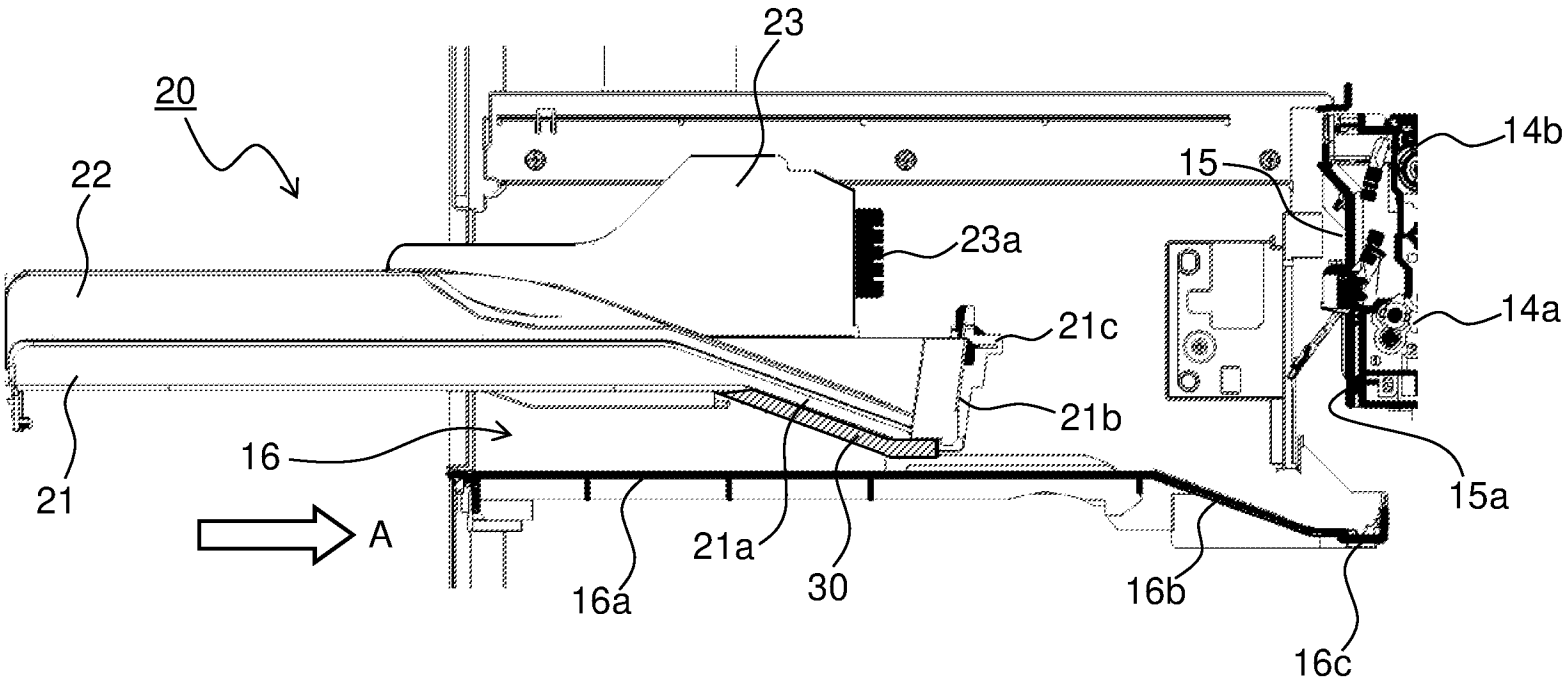
FIG. 3 is a side view showing how the sorting device is mounted in the sheet discharge space, as seen from in front of the image forming apparatus.
Figure 4:
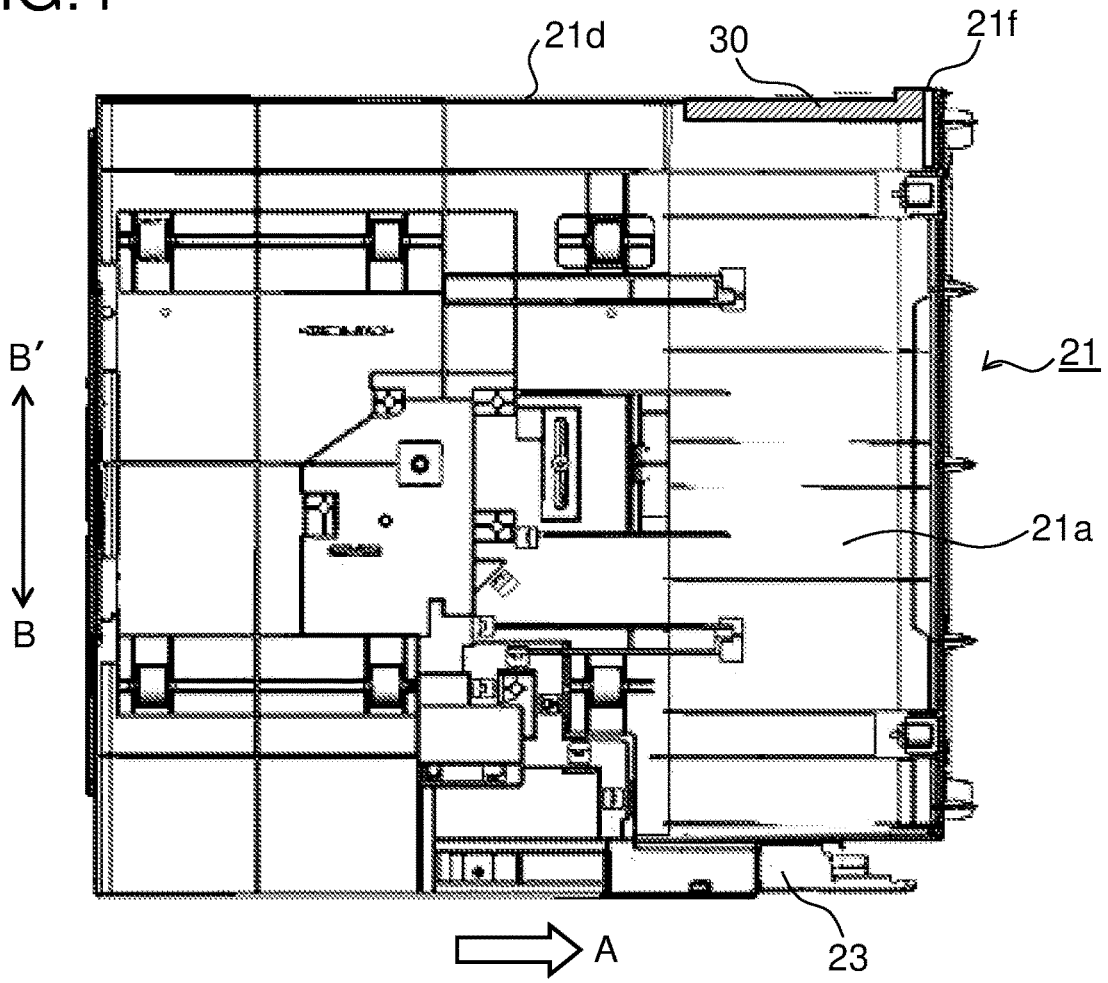
FIG. 4 is a plan view of the sorting device, as seen from beneath.
Figure 5:
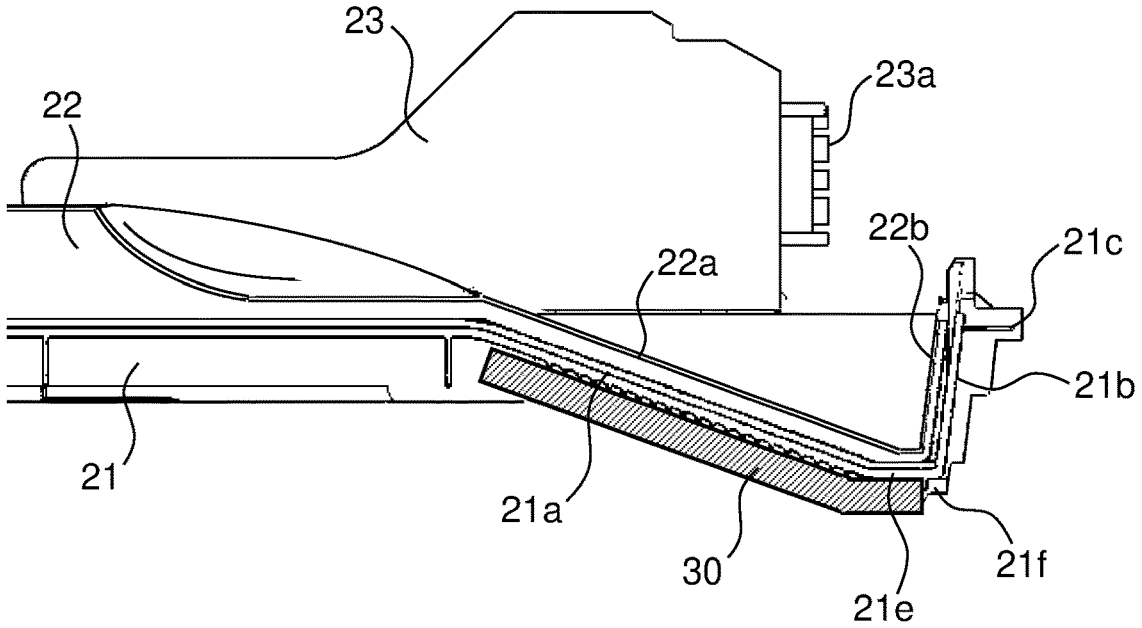
FIG. 5 is a sectional part view around a first inclined portion of the sorting device, cut along a sheet discharge direction.

FIG. 2 is a perspective view showing how the sorting device 20 is mounted in the sheet discharge space 16, as seen from above. FIG. 3 is a side view showing how the sorting device 20 is mounted in the sheet discharge space 16, as seen from in front of the image forming apparatus 100. FIG. 4 is a plan view of the sorting device, as seen from beneath. FIG. 5 is a sectional part view around a first inclined portion 21*a* of the sorting device 20, cut along the sheet discharge direction. The sorting device 20 includes a base portion 21, a tray portion 22, and a flexible member 30.

The base portion 21 is attached to the bottom portion 16*a* of the sheet discharge space 16. The base portion 21 has, as seen from a side, substantially the same bent shape as the bottom portion 16*a* of the sheet discharge space 16, and has a first inclined portion (base inclined portion) 21*a* and a first rear wall portion 21*b*. With the base portion 21 fixed to the bottom portion 16*a*, the first inclined portion 21*a* faces the bottom inclined surface 16*b*, and is inclined, like the bottom inclined surface 16*b*, upward toward the downstream side in the sheet discharge direction. With the base portion 21 attached to the bottom portion 16*a*, a gap is left between the bottom inclined surface 16*b* and the first inclined portion 21*a*. The first rear wall portion 21*b* rises from a bottom end part of the first inclined portion 21*a*, and faces a second rear wall portion 22*b* of the tray portion 22. On the first rear wall portion 21*b*, an engaging portion 21*c* is formed. On an inner wall surface 15 of the sheet discharge space 16 that faces the first rear wall portion 21*b*, the pairs of discharge rollers 14*a* and 14*b* are disposed, and under the pair of discharge rollers 14*a*, an engaged portion 15*a* with which the engaging portion 21*c* engages is provided. Between the first inclined portion 21*a* and the first rear wall portion 21*b*, a flat portion 21*e* is formed, and a rib 21*f* is provided that protrudes downward from a downstream end part of the flat portion 21*e* in the insertion direction (arrow-A direction) of the base portion 21 and that extends in the sheet width direction (arrows-BB' direction)

The bottom surface of the first inclined portion 21*a* is fitted with a flexible member 30. As shown in FIG. 4, the flexible member 30 is attached by being bonded over a band-shaped area with a predetermined width (here, 10 mm)

along an edge 21*d* of the first inclined portion 21*a* at its near side (at the front of the image forming apparatus 100, in arrow-B' direction) with respect to the sheet width direction.

As shown in FIG. 5, the flexible member 30 extends along the inclination of the first inclined portion 21*a* up to the rib 21*f* on the base portion 21, and protrudes downward beyond the rib 21*f*. The thickness of the flexible member 30 as it is before the base portion 21 is attached to the bottom portion 16*a*, that is, with no external force acting on the flexible member 30, is larger than the gap between the first inclined portion 21*a* and the bottom inclined surface 16*b* as it is with the base portion 21 attached to the bottom portion 16*a*.

The tray portion 22 is supported on the top surface of the base portion 21 so as to be reciprocatable in the sheet width direction (arrows-BB' direction), and on the tray portion 22 are stacked sheets discharged from the pair of discharge rollers 14*a*. The tray portion 22 has a second inclined portion 22*a* and the second rear wall portion 22*b*. The second inclined portion 22*a* faces the first inclined portion 21*a* of the base portion 21, and is inclined, like the first inclined portion 21*a*, upward toward the downstream side in the discharge direction. The second rear wall portion 22*b* rises from a bottom end part of the second inclined portion 22*a*, and aligns the trailing ends of sheets that have slid down along the second inclined portion 22*a*.

In an end part of the base portion 21 at its far side (at the rear of the image forming apparatus 100, in arrow-B direction), a connection portion 23 is provided upright. The connection portion 23 includes a connector 23*a* to which is connected a cable for transmitting electric power and control signals to the sorting device 20. Between the base portion 21 and tray portion 22, there is disposed a driving mechanism (not illustrated) comprising a motor, a gear, and the like for reciprocating the tray portion 22.

Sorting with the sorting device 20 proceeds as follows. With the tray portion 22 located at one side (e.g., in arrow-B direction) of the base portion 21 with respect to the sheet width direction, sheets are discharged onto the tray portion 22. The sheets discharged on the tray portion 22 slide along the inclination of the tray portion 22 toward the upstream side in the discharge direction, and their trailing ends are aligned by the second rear wall portion 22*b*. When a predetermined number, which is determined beforehand, of sheets have been discharged, the tray portion 22 is moved toward the other side (in arrow-B' direction) in the sheet width direction.

When the subsequent predetermined number of sheets have been discharged, the tray portion 22 is moved once again toward the one side (in arrow-B direction) in the sheet width direction. Such operation is repeated, so that bundles of sheets sorted in units of the predetermined number of sheets in the sheet width direction are stacked on the tray portion 22.

Next, how the sorting device 20 is mounted in the image forming apparatus 100 will be described. First, as shown in FIG. 3, a downstream end part of the sorting device 20 (a downstream end part of the base portion 21) with respect to the insertion direction (arrow-A direction) is placed on the bottom portion 16*a* of the sheet discharge space 16.

In the state shown in FIG. 3, an upstream part (the left side in FIG. 3) of the sorting device 20 in the insertion direction is held in hand, and the sorting device 20 is pushed inward in the insertion direction with an upstream end part of the base portion 21 kept away from the bottom portion 16*a*.

Figure 6:
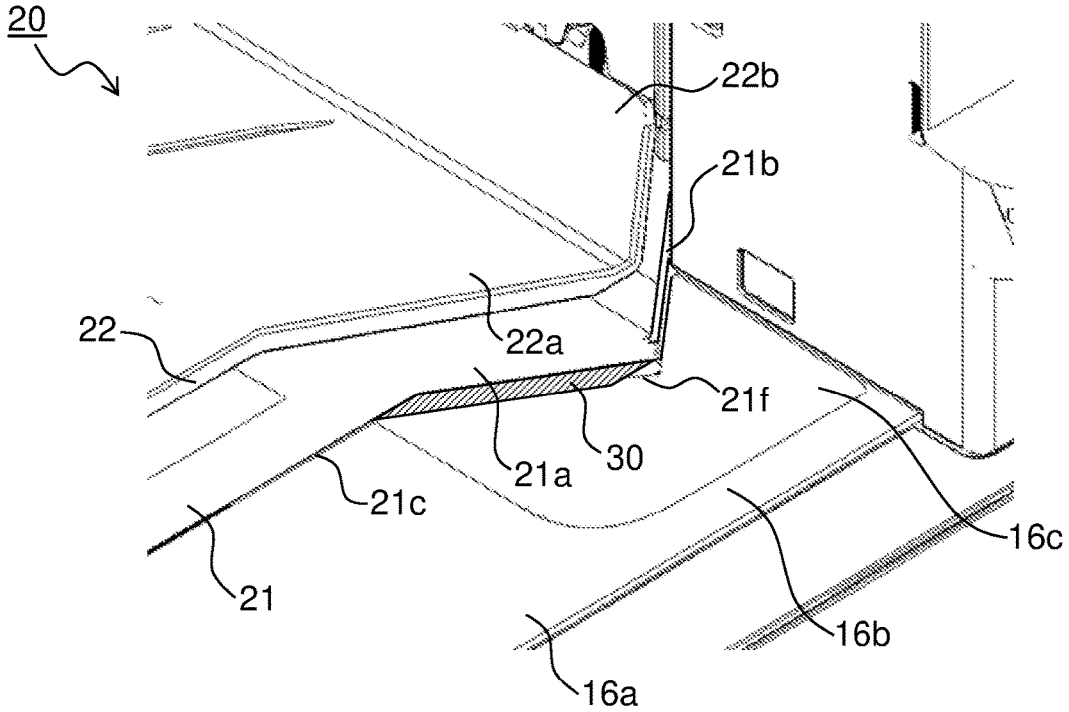
FIG. 6 is an enlarged perspective view around a bottom inclined surface, immediately before the sorting device is mounted.

FIG. 6 is an enlarged perspective view around the bottom inclined surface 16*b*, immediately before the sorting device 20 is mounted. When the first inclined portion 21*a* of the sorting device 20 reaches the bottom inclined surface 16*b*, as shown in FIG. 6, the flexible member 30 makes contact with the bottom inclined surface 16*b* and slides on the bottom inclined surface 16*b*. When the sorting device 20 is inserted up to a predetermined position, the engaging portion 21*c* (see FIG. 5) engages with the engaged portion 15*a* (see FIG. 3), and this completes the mounting of the sorting device 20. In this state, the flexible member 30 is compressed between the first inclined portion 21*a* and the bottom inclined surface 16*b* to fill the gap between the first inclined portion 21*a* and the bottom inclined surface 16*b*.

To remove the sorting device 20, in the state shown in FIG. 1, an upstream part of the sorting device 20 with respect to the insertion direction is held in hand, and the sorting device 20 is pulled outward in the extraction direction (leftward in FIG. 1) with an upstream end part of the base portion 21 kept away from the bottom portion 16*a*.

Figure 7:
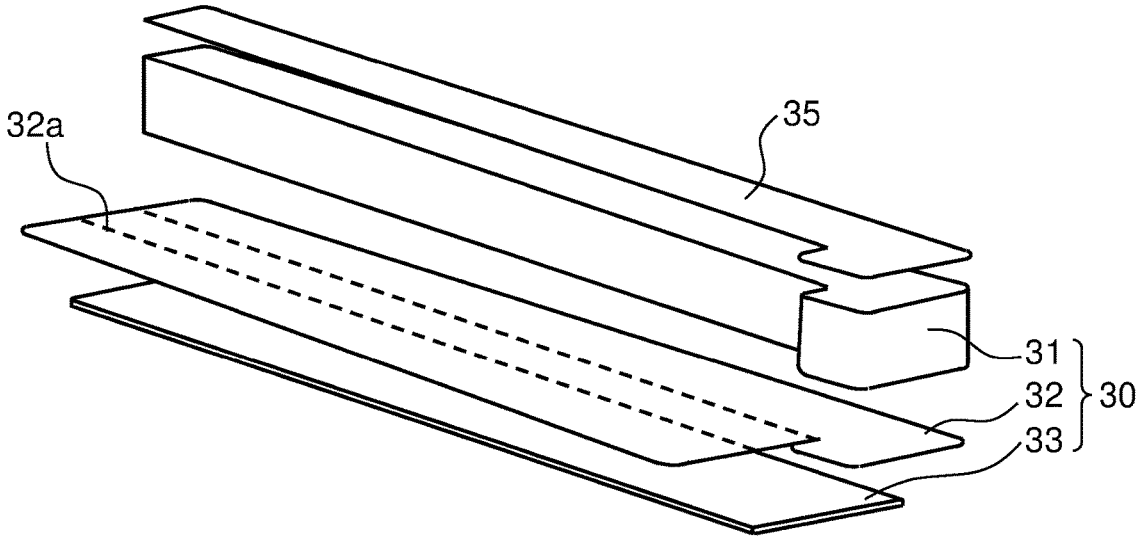
FIG. 7 is an exploded perspective view showing a layered structure of a flexible member.

FIG. 7 is an exploded perspective view showing a layered structure of the flexible member 30. The flexible member 30 is composed of an elastic portion 31, a holding sheet 32, and a sliding portion 33 stacked in this order from the base portion 21 side. The elastic portion 31 is a main portion (base portion) of the flexible member 30, and is formed of a material with predetermined elasticity (resilience). Examples of the material for the elastic portion 31 include sponge and urethane foam.

The holding sheet 32 is bent along a folding line 32*a* to cover the circumferential surface of the elastic portion 31, and thereby prevents the elastic portion 31 from being exposed to the outside, offering an improved look (appearance). The holding sheet 32 also gives adequate rigidity to the sliding portion 33 attached to the bottom surface of the elastic portion 31 in a case where the elastic portion 31 is formed of a soft material. Examples of the material for the holding sheet 32 include PET (polyethylene terephthalate) film.

The sliding portion 33 is attached to the elastic portion 31 via the holding sheet 32, and lies in contact with the bottom inclined surface 16*b*. Usable as the material for the sliding portion 33 is a material with a lower friction coefficient than the elastic portion 31 with respect to the bottom inclined surface 16*b*, examples of such materials including artificial leather, non-woven fabric, and felt.

The top surface of the elastic portion 31 is attached to the first inclined portion 21*a* of the base portion 21 by being bonded with two-sided adhesive tape 35. Though not illustrated, also the elastic portion 31 and the holding sheet 32, and the holding sheet 32 and the sliding portion 33, are fixed together by being bonded with two-sided adhesive tape.

In the construction according to the embodiment, with the sorting device 20 mounted in the bottom portion 16*a* of the sheet discharge space 16, the flexible member 30 fills the gap between the first inclined portion 21*a* of the base portion 21 and the bottom inclined surface 16*b*. It is thus possible to prevent entry of foreign matter, such as a clip, into the gap between the first inclined portion 21*a* and the bottom inclined surface 16*b*.

Owing to the flexible member 30 being provided such that it protrudes downward beyond the rib 21*f* on the base portion 21, when the sorting device 20 is mounted and removed, only the flexible member 30 makes contact with the bottom portion 16*a* and the bottom inclined surface 16*b*. This makes it possible to insert and extract the sorting device 20 smoothly, and it is also possible to prevent the rib 21*f* from rubbing against the bottom portion 16*a* or the bottom inclined surface 16*b* and giving off abrasive noise or scratching the bottom inclined surface 16*b*.

Owing to the flexible member 30 including the elastic portion 31 and the sliding portion 33, when the sorting device 20 is mounted and removed, it exhibits improved sliding. Moreover, owing to the holding sheet 32 being provided to cover the circumferential surface of the elastic portion 31, the elastic portion 31 is prevented from being exposed to the outside, offering an improved look and, in a case where the elastic portion 31 is formed of a soft material, the sliding portion 33 can be given adequate rigidity.

The present disclosure is in no way limited by the embodiment described above and allows for many modifications without departure from the spirit of the present disclosure. For example, while in the embodiment described above the flexible member 30 is composed of the elastic portion 31, the holding sheet 32, and the sliding portion 33, the holding sheet 32 is not an essential element: in a case where the elastic portion 31 has predetermined rigidity, the sliding portion 33 may be bonded directly to the elastic portion 31.

The present disclosure is appliable to a sorting device that is mounted in a sheet discharge space in an image forming apparatus. Based on the present disclosure, it is possible to provide a sorting device that, when mounted in the sheet discharge space in the image forming apparatus, can fill the gap between it and the bottom surface of the sheet discharge space and that can be mounted and removed easily and can reduce the abrasive noise it produces when mounted and removed; it is also possible to provide an image forming apparatus provided with such a sorting device.

What is claimed is:

1. A sorting device mounted in a sheet discharge space formed in an image forming apparatus, the sheet discharge space being open at a front of the image forming apparatus and at a downstream side thereof in a sheet discharge direction, the sorting device being mounted so as to be insertable or extractable at the downstream side of the image forming apparatus, the sorting device comprising:

a base portion mounted on a bottom portion of the sheet discharge space in the image forming apparatus; and a tray portion supported on the base portion so as to be reciprocatable in a sheet width direction orthogonal to the sheet discharge direction, wherein the base portion is mounted integrally with the tray portion so as to be insertable or extractable along a top surface of the bottom portion from a downstream side in the sheet discharge direction, the base portion has, on an upstream part thereof in the sheet discharge direction, a base inclined portion inclined upward from upstream side toward the downstream side and, with the base portion mounted in the bottom portion, the base inclined portion faces, with a predetermined gap, a bottom inclined surface provided in an upstream part of the bottom portion in the discharge direction, the bottom inclined surface being inclined upward from upstream side toward the downstream side, and the base inclined portion is attached with a flexible member for filling the gap between the base inclined portion and the bottom inclined surface.

2. The sorting device according to claim 1, wherein the flexible member has a stripe shape and is attached along a front edge part of the base inclined portion in the sheet width direction.

3. The sorting device according to claim 1, wherein the base portion has:

a rear wall portion provided upright on an upstream side of the base inclined portion in the sheet discharge direction;

a flat portion formed between the base inclined portion and the rear wall portion; and a rib protruding downward from a bottom part of the flat portion, and an uptream end of the flexible member in the sheet discharge direction protrudes downward beyond the rib.

4. The sorting device according to claim 1, wherein a thickness of the flexible member is larger than the gap between the base inclined portion and the bottom inclined surface in a state where no external force is applied.

5. The sorting device according to claim 1, wherein the flexible member includes:

an elastic portion having one side surface attached to the base inclined portion ;and a sliding portion attached to the other side portion of the elastic portion so as to face the bottom inclined surface and sliding on the bottom inclined surface, and the sliding portion has a lower friction coefficient than the elastic portion with respect to the bottom inclined surface.

6. The sorting device according to claim 5, wherein the flexible member has a holding sheet covering an outer peripheral surface of the elastic portion, and the sliding portion is attached to the elastic portion via the holding sheet.

7. An image forming apparatus, comprising:

an image forming portion that forms an image on a sheet;

a discharge portion that discharges the sheet having the image formed thereon by the image forming portion into the sheet discharge space; and the sorting device according to claim 1 that sorts the sheet discharged from the discharge portion.

* * * * *